United States Patent [19]

Wayman

[11] 4,205,852

[45] Jun. 3, 1980

[54] CROSSWORD SYSTEM, GAME AND APPARATUS

[76] Inventor: Paul L. Wayman, 918-B Orleans, New Oreleans, La. 70116

[21] Appl. No.: 870,872

[22] Filed: Jan. 20, 1978

[51] Int. Cl.[2] ..... A63F 3/00

[52] U.S. Cl. ..... 273/272; 35/35 H

[58] Field of Search ..... 35/35 H, 35 J; 273/272; 283/1 R

[56] References Cited

U.S. PATENT DOCUMENTS

| | | | |
|---|---|---|---|
| 2,055,159 | 9/1936 | Scofield | 273/272 |
| 2,239,970 | 4/1941 | Osborne | 35/26 |
| 2,795,863 | 6/1957 | Warwick | 35/35 H |
| 3,290,800 | 12/1966 | Le Dell | 35/35 J |
| 3,811,206 | 5/1974 | Gaccetta | 35/35 H |

FOREIGN PATENT DOCUMENTS

| | | | |
|---|---|---|---|
| 885340 | 12/1961 | United Kingdom | 273/272 |

*Primary Examiner*—Harland S. Skogquist
*Attorney, Agent, or Firm*—C. Emmett Pugh & Associates

[57] ABSTRACT

A crossword puzzle system for creating crossword puzzles including the steps of (a) obtaining a crossword puzzle grid defining sections; (b) inserting "generator" words into the grid; (c) making "possibility" check from a provided "Table of Average Preference Values"; (d) assigning "C" (consonant) and "V" (vowel) locations based on highest frequency rate with the longest words done first and with "possibility" checks done as needed; (e) determining the relative priorities of the crossword puzzle grid sections; and (f) filling in the blanks with the use of provided "Paralog" lists starting with the most difficult. The principles of the system can be used to provide a crossword game device and method of play for, for example, one to four persons with the likely result of a game being a completed crossword array, such as is the object of the conventional crossword puzzle, which game includes a flat game board with an exemplary crossword puzzle playing surface grid of fifteen rows by fifteen columns for flat tiles of three classes placed on the board, a sorting means based on simple magnetic principles, and lettered playing pieces for placement on the playing surface according to their consonant or vowel classification in the form of a linear word, which lettered playing pieces have indented areas on their undersides for mating with corresponding "V" or "C" raised areas on the game board.

6 Claims, 14 Drawing Figures

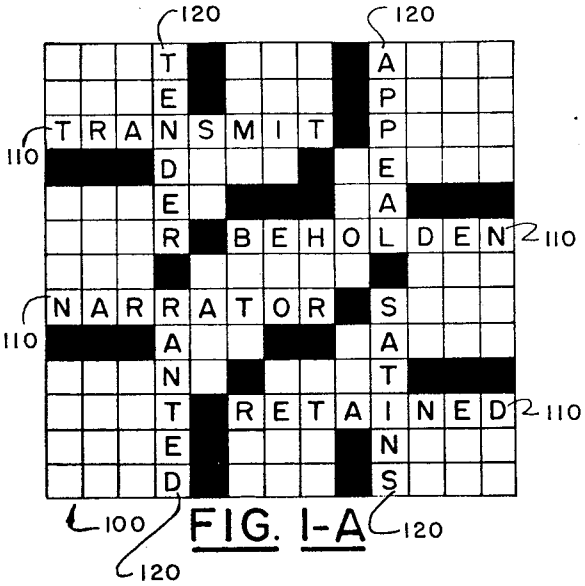
FIG. 1-A
Hyphos
```
v c v T   c v c   A c v c
c v c E   v c v   P v c v
T R A N S M I T   P c v c
    D v c   c E v c
c v c v R   c v A c
N A R R A c v   B E H O L D E N
    A c v   c v c v
c v c v c   S v v c
c v c v E   R E c v
c v c D   c v c   S v v c
```
FIG. 1-B
Priorities
| | | |
|---|---|---|
| | 1 | 7 | 5 |
| | 9 | 8 | 6 |
| | 2 | 4 | 3 |
FIG. 1-C
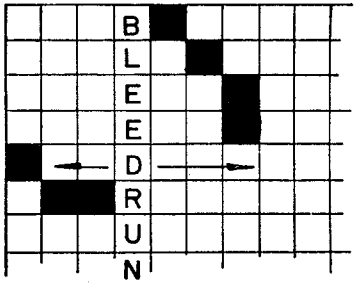
FIG. 3-B
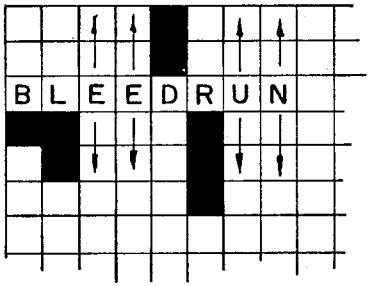
FIG. 3-A
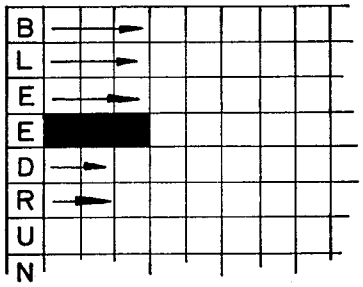
FIG. 2-B
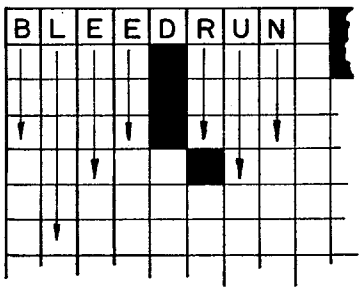
FIG. 2-A

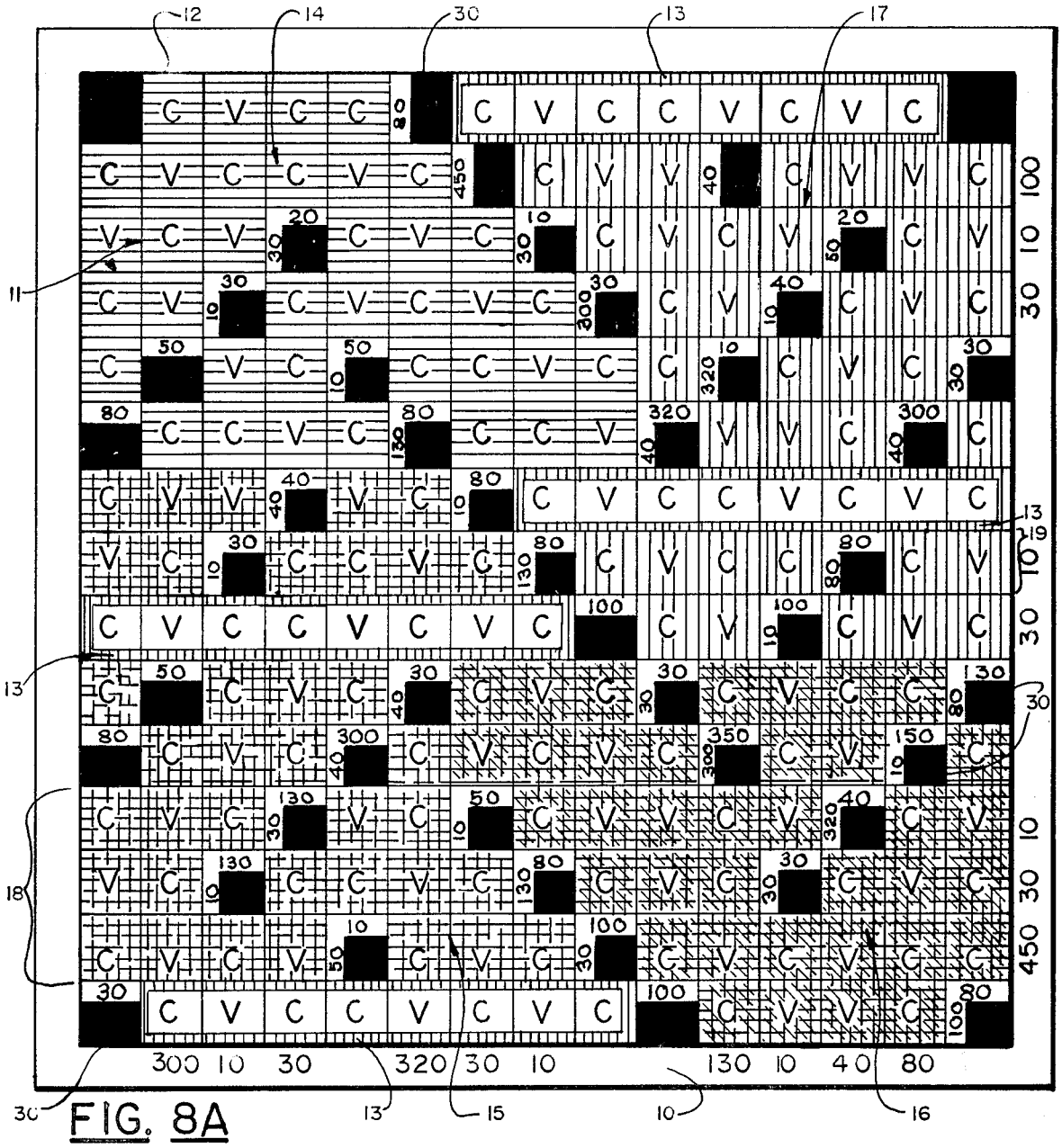
FIG. 8A
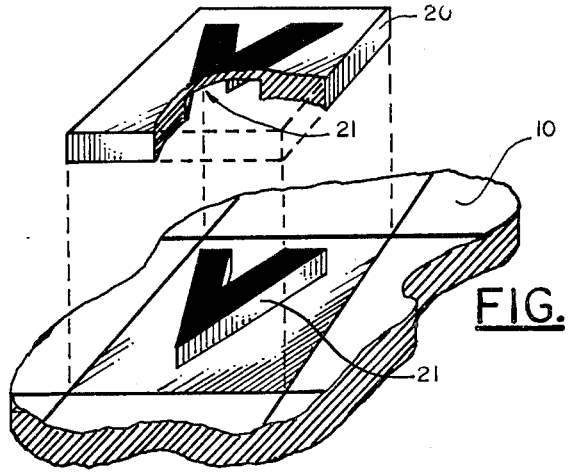
FIG. 8-B

CROSSWORD SYSTEM, GAME AND APPARATUS

BACKGROUND OF THE INVENTION

1. Field of the Invention

The present invention relates to a system for creating crossword puzzles and to a related game and method of generating crossword puzzles or word arrays, including a rearrangeable playing surface with means for sorting after play the three classes of pieces constituting that surface.

2. Description of the Prior Art

The patent literature in the game art, generally, is quite extensive. Applicant is aware of the U.S. Patent to Brunot, et.al., (U.S. Pat. No. 2,752,158, issued June 26, 1956) for a "Game Apparatus". Notice is also taken of the word-game known as "SCRABBLE".

3. General Discussion of the Invention

The crossword puzzle is an enjoyable solitaire diversion for many persons, with an estimated 30 million people devoted to solving such puzzles in the United States alone.

A crossword puzzle may be described as:

"A puzzle which displays a square of rectangular, symmetric matrix of multiple individual letter squares each of which is intended to contain a single letter which helps to spell both a horizontal word and a vertical word. In the United States the puzzle ranges in size from 169 to 529 letter squares as a general rule, with a large proportion of them being 225 squares (15×15). Fifteen to 20% of the squares are blocked out to divide the puzzle into separate sections (groups of words) which are interconnected by transsectional words. An accompanying numbered definition table provides clues which direct the solver to corresponding identification numbers for the squares in which the initial letters of the interwoven words appear."

While the completion of a blank crossword puzzle may be a difficult exercise, the generation of the same crossword array by the puzzle's author is considerably more difficult (heretofore regarded by the experts in the field as being an art impossible to teach), due to the fact that in each area of the puzzle, each letter of a vertically placed word must in almost every instance be a letter in a suitable horizontal word. The present invention supplies a system for generating or creating crossword puzzles as well as a related means for generating a crossword array either in a solitaire, or in a competitive game atmosphere, with a high probability that a completed crossword array will result. Magnetic means for sorting the playing pieces of the crossword design at the conclusion of the game into their letter classes as well as mating indented and corresponding raised areas on the playing pieces and game board, are included.

While the invention in its preferred game embodiment as disclosed herein has been designed for the American game market and the United States population generally, the principles outlined may be utilized *mutatis mutandis* as an educational tool for foreign language instruction or for facilitating the mastery of disciplines having specialized terminology of their own.

It is noted that the American crossword puzzle is usually formed on a square or rectangular grid area that is subdivided into multiple word placement areas, by black or blank areas and the perimeter of the grid, or by two black or blank areas. The several word placement areas are connected by common words, generally of greater length than the words in each area, serving to link the separate areas. As a general rule within each placement area every letter of every word must also be a letter in a different word running at right angles to the first word. Letters bounded on more than two sides by the perimeter or a black area are excepted from this general rule. Finally, a "word" in a crossword puzzle may be any intelligent combination of letters such as might be found in a dictionary or other source of communicative material.

The crossword puzzle system for creating crossword puzzles of the present invention include the steps of (a) obtaining a crossword puzzle grid defining sections; (b) inserting "generator" words into the grid; (c) making "possibility" check from a provided "Table of Average Preference Values"; (d) assigning "C" (consonant) and "V" (vowel) locations based on highest frequency rate with the longest words done first and with "possibility" checks done as needed; (e) determining the relative priorities of the crossword puzzle grid sections; and (f) filling in the blanks with the use of provided "Paralog" lists starting with the most difficult.

In the game embodiment of the present invention, the game is played and the puzzle array made on a surface configured similar to an unfilled crossword puzzle. However, the word placement areas are composed of linear patterns (either running horizontally or running vertically) of spots for consonant letter playing piece placement (marked "C") and of spots for vowel letter playing piece placement (marked "V"), opposed at right angles and comprising segments of a full row or full column of the array appearing on the playing surface.

In play, a crossword "word" must be formed of a specific number of lettered playing pieces on a horizontal or on a vertical linear segment and must conform to the consonant-vowel distribution pattern dictated by the "C" and "V⇄ marked spots, respectively, on the playing surface. Multiple arrays of the game can be graded as to difficulty. For each array, referent linear patterns and the playing piece potentials are designed to optimize the likelihood that each linear segment and each area of the array will be completed with a set of words, each of which shares letters with other words.

The referent linear patterns were chosen by calculating the frequency of appearance of words in the language having each possible consonant-vowel distribution pattern, "CCV" or "CVCV" for example, for each possible horizontal and each possible vertical linear segment in an array, adding those pattern-appearance frequencies in an area, then optimizing and grading difficulty of an array by choosing a set of interrelated pattern with the appropriate sum of frequencies, i.e., with an appropriately graded probability for each array for the use of words in the language for which the puzzle is made that can fill each linear segment and each area of the array.

The playing piece selection potentials for play on all arrays are chosen by first calculating the frequency of appearance of vowels and of consonants in the language in words of the lengths appearing on the arrays, and allowing those proportions for each class (vowel or consonant) of playing piece. The vowels are then provided with a distribution of playing pieces in accordance with their respective appearance frequencies in words of array-length; the consonants are provided with such a skewed frequency distribution as to maximize the statistical probability of random access to consonant-lettered playing pieces which, combined with an average selection of vowel-lettered playing pieces in the numbers and ratios allowed to be played in a game turn, make words that are more widely known and used in the general population than are all the words which make up the universe from which the overall letter distribution calculations were taken.

At the conclusion of a game, prior to commencement of another round of play, the playing pieces must be separated into their respective classifications (vowels, consonants, and blanks), in preparation for the following game. The sorting mechanism of the present invention is based on simple magnetic principles.

Mistakes in play are corrected, and strategic blocking of an opponent's play provided, by the use of an inverted (base up) letter playing piece. Only two classes of letter playing pieces (consonant pieces and vowel pieces) are used, one class of which is formed of a magnetic material, and the playing surface is of a material to which the magnetic playing piece is attracted. That class of playing piece which is magnetic is designated as the class to be used inverted (no letter showing on the base of the playing piece) to serve the purpose of a blank playing piece during play. Those playing pieces which have no magnetic properties are dropped from the playing surface by inverting the game board at the conclusion of a game, and collected, while those playing pieces having magnetic properties are retained on the inverted playing surface and when the playing surface is restored to its original position, from there collected; the sorting process is thus complete.

To insure the proper placement of the playing pieces on the board, the playing pieces include on their underside indented area corresponding to raised portions on the game board. Thus a vowel playing piece would have on its underside a "V" shaped indentation allowing it to be placed only on a mating "V" raised portion on a vowel square.

BRIEF DESCRIPTION OF THE DRAWINGS

Further advantages and objects of the present invention will become apparent from the detailed description of the preferred embodiments and from the drawings hereof wherein:

FIG. 1A is a plan view of an exemplary crossword puzzle grid with initial generator words added in accordance with the principles of the present invention; while FIG. 1B is a hyphos for the puzzle of FIG. 1A; and FIG. 1C is a "tic-tac-toe" grid indicating the relative difficulties of the various sections of the puzzle of FIG. 1A.

FIG. 2A through FIG. 7B inclusive are exemplary representations of various aspects of possible crossword puzzle segments illustrating the principles of the present invention.

FIG. 8A is a plan view of one game board of the preferred game embodiment of the present invention, showing an exemplary grid pattern for play; while FIG. 8B is a perspective view of an exemplary "V" (vowel) playing piece (partially cut-away) for the game board of FIG. 8A.

DETAILED DESCRIPTION OF PREFERRED EMBODIMENTS

Introduction

Figure 6:
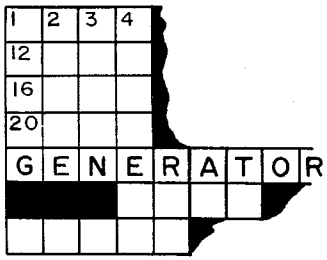

Initially the preferred embodiment of the system or method of the present invention for generating or creating crossword puzzles will be detailed. Then the preferred exemplary embodiment of the game based on the principles of the system will be described in detail.

Method for Generating Crossword Puzzles

In the method or system of the present invention for creating crossword puzzles, a desired puzzle grid with blackened areas is selected or provided, based on generally arbitrary principles, although an upper maximum of fifteen to twenty percent of blackened area is typical and reasonable symmetry of the overall grid pattern is desired. Also in generating a puzzle it may be desired to include a particular word or words in for example a topical promotion or advertising puzzle.

The second step is to select and insert "Generator" words in the transsectional positions of the grid, and in subsequent steps to complete a proposed crossword puzzle.

It should be noted that the present invention is not concerned with the definition part of a cross-word puzzle but only the solutions or words for the puzzle grid, for which words the definition tables can be made. There are two reasons for this. First: The average crossword puzzle has some eighty or so entries (the very first one had thirty-two). Most of those entries can be defined in more than one way (some words have more than one hundred ways). If one assumes an eighty entry puzzle, and assumes that each entry has two definitions only, then the different ways in which one could set up a definition table would be astronmical.

Second: Crossword crafting begins with preparation of a completed solution, or filled-in framework, which is the area to which the present invention is directed. Once this is finished, each of the words in the solution is provided with its definition, and all these are set out in a numbered table. Because the definition table is the point at which the craftsman's personality first appears to the solver, definitions are left as personal with the user. Thus the present invention does not give definitions for use with the puzzles, but rather provides understanding of construction methodology so that the users can make completed solutions ready for their own definitions.

The word hyphography is derived from two Greek words; hyphē, meaning "web" (which we also use in sense of template), and graphein, meaning "to write". In hyphography, the craftsman creates a hyphos for his puzzle framework before he begins lettering and before he seeks words to go into his puzzle (other than special words called bleed runs, which will be explained later). The hyphos is crafted solely with the purpose of screening letters which will later be determined so as to separate them into two categories only: vowels and consonants. This is an alphabetic split about 43%–57% when measured by frequency of use of words of the normal length found in crossword puzzles.

The hyphos provides a working matrix, scattered with symbols for vowels and for consonants, which are then replaced with specific letters for the words of the puzzle solution. It should be understood that the hyphos is not randomly patterned with symbols for vowels and for consonants. These symbols are placed with a mathematical precision in accordance with the steps of the present invention.

Each section of the puzzle is patterned separately in the design of a hyphos. When the section is completed, it has a numerical value related to the frequency of use of vowel and consonant distributions in words of the lengths contained in that section, and hence may be called "probability-controlled." When the entire hyphos is complete, the various sections of the puzzle are given priority numbers for further attention, according to the relationships among their respective letter-category frequencies. A completed hyphos may be used over and over again to make entirely new puzzles. The re-use of a hyphos however, usually requires replacement not just of the words directed to be placed the first time around; it usually requires replacement of bleed runs previously used as well. (All these matters will be explained in further detail below.) In the long run the ability to use and re-use a hyphos over and over again results in a time savings which can cut production time for second and subsequent puzzles by 75% to 80%. This is as true for the veteran craftsman as it is for the beginning tyro.

An important part of the hyphography of the present invention is: Complete the tasks in descending order of difficulty. (A corollary to this is, work from the largest possible store of words.)

As noted above, it is important to complete the tasks in descending order of difficulty. Deviation from this rule can cost unnecessary time in correcting mistakes which would have been smaller, or could have been avoided altogether if the rule had been obeyed.

For example: In crafting a puzzle in accordance with the present invention, the puzzle is complete one section at a time. Sections differ in grades of difficulty, but all sections together constitute the unit which an editor judges. The repeating of a word within the unit is generally not allowed, even though the definitions are so unrelated that they cannot be confused, (e.g., BEEF in one place might be defined as "meat" and in another as "gripe" were it not for the editorial restriction on using the same word twice in one solution). The total store of words which can be used is limited but the larger the store available to draw from, the easier it will be to find an appropriate word. If the easier sections are worked first, using words from the user's store, the size of that store is reduced. Then, when the harder sections are reached, some potentially useable words have already been eliminated from consideration at the very point where the largest store is most needed. They have already been used one time.

As another example: With rare exceptions, each letter in the puzzle will be carrying both a horizontal burden as part of a horizontal word, and a vertical burden as part of a vertical word. Should one start by filling in the short words just because they are easier than the longer ones, the way one might do when solving a puzzle, one may soon find one or more letters entered in a longer letter-run, and find that those letters are in positions which no word can accommodate (this is called an "impaction"). Extensive corrections may be required. On the other hand, if one lets the longer letter-run act as a generator and fills it in first, then lets the shorter runs which will share its letters derive from the generator, any corrections necessary because of impaction will be less extensive and much more easily made.

For purposes of this rule of completing tasks in descending order of difficulty the present invention is concerned with three measures of difficulty. These three measures dictate the efficient procedure in crafting a puzzle.

1. Differing lengths of letter runs;
2. Comparative use-frequencies of vector paths (see below for definition of this term); and
3. Comparative use-frequencies of letters in position in a vector path.

The effect of the first of these measures (why disposing of the longest word first is essential) has already been noted.

As to the other two measures, it is noted that a vector path in the present context is the vowel-and-consonant ("V-and-C") distribution pattern displayed by a word in the language. Thus CVCV would be the vector path for the words COME, GONE, HAVE, and so on. These words begin with a consonant, this is followed by a vowel, which in its turn is followed by a consonant and that is followed by another vowel. And the vector VCVC would be the one followed by AGES, ERIN, ICED, OVER, and so on. The vector path CVCCVCC could represent BALLAST, or WORKING, as longer examples. The "Basic Paralogs" which are part of the present invention, constitute a listing of words of for example, three, four, and five letter lengths which are found in American desktop dictionaries of current publication, all grouped according to length and sorted according to their vectors. Use-frequency variations among vector paths are an important part of the hyphography of the present invention. Their dynamics point to familiar letter combinations and identify the less familiar. The provide the means of preparing a hyphos, or working matrix, which is the pattern to be followed for the most rapid crossword creation possible.

Given a puzzle framework, crafting the puzzle is a four step procedure, at the conclusion of which the user is at the point of readiness to set down a definition table. These four steps must be taken in the order shown; they follow logically from each to the next;

1. Insertion of generator words. (These are the very longest in the framework, and are all transsectional, bleed-run words.)
2. Development of the principal derivatives of those generators. (These are transsectionals which share letters with generators.)
3. Establishment of vector controls for the entire framework. Generators and principal derivatives are regarded in terms of vector paths only; vectors are run from those for the remaining letter runs. The vector values are totaled in each section, then each section's values are averaged to compare relative difficulties of all. A working matrix, or hyphos is thus produced, which controls the balance of work by statistics.
4. Insertion of words in the framework, section by section from the hardest to the easiest, in accordance with the vector controls, incorporating the letters already present in the generators and their principal derivatives.

To illustrate the system of the present invention, in the framework 100 of FIG. 1A exemplary generators 110 and their principal derivative 120 are filled in, and the corresponding vector controls established appear in FIG. 1B. Generator words 110 are the longest transsectional words either vertical or horizontal in an area of the grid framework, while the principal derivatives 120 are the longest words in that area which also transect the generator word. Also in FIG. 1C a "tic-tac-toe" type skeleton of the framework is presented, to show the relative difficulty of each section. In order to follow the "road map" of the vector controls given in the hyphos of FIG. 1B and complete the fill-ins within the framework 100 for the entire puzzle, one should begin with the section numbered 1 and in ascending order through section numbered 9 in the "tic-tac-toe" skeleton of FIG. 1C, completing each section in turn.

In order to accustom oneself to thinking in more concrete terms about the vectors be be used, reference should be made to the exemplary "Basic Paralogs" listed below, while inserting proposed words in the framework. Since the bleedruns are already in place, when one is working with the "Paralogs" one will want to substitute a "C" in a vector for each consonant in a bleed run, and a "V" for each vowel. Thus, the first vector at the top left of the puzzle of FIG. 1A, reading horizontally as directed by the hyphos, appears as "VCVT", this would appear in the "Paralogs" as "VCVC". The first vector at the top left, reading vertically as directed by the hyphos, appears as "vcT"; this would be a "Paralog" word shown as "VCC".

In filling in the rest of the framework 100, it should be realized that one had, in each case, a choice of words to be inserted, any one of which choices would make just as good a puzzle as the one actually made. And it should not be difficult to find suitable words for the various sections, either. The conclusion should be apparent that one could make several different puzzles without any change in the framework, the generators, or their principal derivatives. What is perhaps less apparent but still true, one could change these bleed runs to other words which have identical vector paths, and the hyphos would still be as good a master pattern to follow as it was for the puzzle presented in FIG. 1A.

As noted above, the first two steps in the crafting of a puzzle in accordance with the method and system of the present invention, are to put in the generators and their principal derivatives. These words are always 'bleed runs'. A bleed run has part of its letters in one section of the framework, and part of them in another section. Sometimes it will have letters in more than two sections; this depends on the kind of framework selected or designed. The bleed run is also referred as a transsectional, meaning simply that it is a word which cuts across sections.

A transsectional can be located in any one of three places:

(1) It can share the first letter of a word (or words in the section. In that case, those words in the section with which it shares letters, will run perpendicularly down from, or toward the right of, the bleed run, as is shown in FIG. 2-A in the former case and in FIG. 2-B in the latter.

(2) The transsectional can share an internal letter of a word (or words) in the section. In that case, those words in the section with which it shares letters will run in two directions away from the bleed run: either up and down from the horizontal bleed run, or right and left from the vertical bleed run, as is shown in FIG. 3-A for the former case and in FIG. 3-B for the latter.

Figure 4:
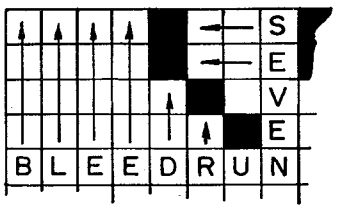

(3) The bleed run can share the last letter of a word (or words) in the section. In that case, those words will run perpendicularly upward from, or toward the left of, the bleed run, as is shown in FIG. 4.

There is also, as a final possibility, the case where two or even all three of these situations could occur with respect to a single bleed run. Words may be running in both directions away from the bleed run, while other words are at the same time beginning with it, and still other words are at the same time terminating in that bleed run. An example of such a case is seen in FIG. 3-A above. The word which is to share the letter 'D' of BLEEDRUN in FIG. 3-A, presents an example similar to that given in FIG. 2-A; the words sharing the letters 'B', 'L', and 'R' in FIG. 3-A provide an example similar to that given in FIG. 4.

Although bleed runs may appear at any point in a framework, and will join two or more sections, the sketches above exemplify and completely exhaust what can occur respecting them.

Primarily because the bleed run cuts across more than one framework section (or cuts across one and into another), but also because it is in nearly every case longer than the section-confined words whose letters it shares in accordance with the present invention, it should be filled in first before one fills in any runs that do not bleed. It is of course possible for a three-letter word to constitute a bleed run connecting two sections, but this does not often occur. Even when such a case does arise it is necessary that the three-letter bleed be filled in as the hyphos is being prepared so that one will know whether the shared letter in each of the two sections is a vowel or a consonant.

The point to be noted is that shared letters of a bleed run are categorized as vowels or consonants, before one starts the next step of the matrix preparation. If one were to omit that step, one would find oneself having to make the matrix determinations for two sections of the puzzle of one time (or more, if the bleed run shares letters in more than two sections). This contradicts the teaching of the primary rule, and complicates the procedure of establishing a matrix section by section. In this connection, one really does not care about the vowel-consonant distribution of the bleed run, whatever it may be, for (1) the bleed run is already determined and there is no need for alternative choices and (2) the vector value of a bleed run is not figured into a sectional average of such values.

This is not to say that the vector path of the bleed run has no effect on the sectional average one will calculate for each of the sections in which it appears; it does have. (Any time one puts a single letter into a matrix, and any time one categorizes a single letter square of a puzzle as being a vowel or as being a consonant, one has placed a limit on the possible words which can be used in the sharing of the identified letter or category. Obviously, one cannot lace into a framework, a bleed run which has a vector path CCVVCCVC, and expect it to share its third letter with a word which shows a consonant at the shared position. It has already been committed in the bleed run to be a vowel.) So the vector path of the bleed run will affect, but will not contribute a figure to, the attainable value for the section in which it appears.

The impact of a bleed run's limitations on a section which are caused by the fact that it follows a particular vector path, is relatively insignificant. On the other hand, so far as the use of specific letters in that bleed run is concerned, the impact can be materially significant. Because of this, one needs a yardstick to determine comparative impacts before a particular word is placed in the framework as a bleed run. If one knows ahead of time which particular letter, or letters, of the intended bleed run will cause a problem when one starts making a matrix for the section, an informed choice can be made between the intended bleed run and some other word. Once the choice is made and the bleed run is placed on the basis of such a yardstick measurement, one knows in advance what effect it will have on each of the vectors which are to share its letters.

The yardstick provided for this selection in the present invention is called a "Table of Average Preference Values" (APT). There is given below for exemplary purposes, the APT values for four-letter and for five-letter words. (One page for each of the two lengths.) In the AP Table, the stub column at the extreme left side of the page lists the letters in alphabetical order. The other columns are numbered at the top of the page, to show the position of each of those letters in a word of that length for that table. The way a bleed run could cut into or across a word in a section was noted above. The AP Table narrows the point of interest to a particular place in each section confined word where the bleed run will be placed. In other words, the Position 1 column will correspond with bleed runs identified in FIG. 2-A of the earlier discussion. The columns for Position 4 of the four-letter table and for Position 5 of the five-letter table, correspond with bleed runs identified in FIG. 4. FIGS. 3-A and 3-B will correspond with the interior columns of those two tables.

The AP Table gives a number for each letter in each position, which number is both preceded and followed by a lower case letter, either "c" or "v". The figure indicates the percentage of times, in comparison with the average for all the letters in the alphabet, that particular stub letter may be found in the position shown at the top of the column. (Note that these are not raw appearance numbers; they compare the letter's appearance with the average appearance for all letters.) The lower case "c" or "v" which precedes all but the first position use of the letter, indicates whether a consonant "c" or a vowel "v" is found to lead that letter the more often. The lower case letter which follows all but the terminal position of the stub letter, likewise indicates the more frequently found category of letter in the next position following. If the letter is underscored, then its opposing category of letter will never be found in the position for which the lower case letter indicates a preference frequency. If the space preceding or following the number should contain a letter but carries neither the "c" nor the "v" but shows a dash (-), then the frequencies of appearance are so nearly split as to be indifferent to letter category.

TABLE OF AVERAGE PREFERENCE VALUES
Four-Letter Words

| | POSITION | | | |
|---|---|---|---|---|
| LETTER | First | Second | Third | Fourth |
| A | 2.1c | c5.0c | c2.7c | c3.0 |
| B | 1.8v | v .2v | v .6v | v .5 |
| C | 1.5v | v .3v | - .8v | v .2 |
| D | 1.4v | v .3v | v .7v | v1.1 |
| E | .9c | c3.2c | c2.2c | c3.5 |
| F | 1.0v | v *v | v .4v | v .4 |
| G | 1.2v | v .3- | v .6v | v .6 |
| H | 1.1v | c .8v | v .4v | v .8 |
| I | .6c | c3.0c | c1.9c | c1.3 |
| J | .6v | v *v | v .2v | c * |
| K | 1.0v | - .3v | v .6v | -1.1 |
| L | 1.3v | c1.3c | c2.0c | v1.3 |
| M | 1.3v | v .4v | - .9v | v .8 |
| N | .8v | v .7c | -2.1c | v1.5 |
| O | .8c | c4.3c | c1.7c | c1.7 |
| P | 1.6v | v .3v | v .6v | v .8 |
| Q | .1v | v *v | - *c | v .1 |
| R | 1.1v | c1.4- | c2.3c | v1.2 |
| S | 2.2v | v .3c | v1.4v | c1.2 |
| T | 1.5c | v .5v | v1.2v | v2.0 |
| U | .4c | c2.5c | c1.2c | c .7 |
| V | .5v | v .2v | v .5v | v * |
| W | .8v | - .2v | v .4c | v .2 |

-continued

TABLE OF AVERAGE PREFERENCE VALUES
Four-Letter Words

| | POSITION | | | |
|---|---|---|---|---|
| LETTER | First | Second | Third | Fourth |
| X | *v | v *v | v .1v | v .2 |
| Y | .4- | c .5c | c .3c | c3.4 |
| Z | .2v | v *v | v .3v | v * |

Numbered entry = % of statistically probable appearances of letter in position, where probability = U/26,U = universe of words of 4 letters, 26 = letters in alphabet.
* = appearances less than 10% of average.
Lower case letter indicates most frequent category in preceding or following position. Stub letter on left indicates particular letter to which entries refer. (If no lower case letter appears but space is occupied by a dash (-), there is no preference as to vowel or consonant in that adjacency. If lower case letter is underscored, there is no alternative to use of that category.)

TABLE OF AVERAGE PREFERENCE VALUES
Five-Letter Words

| | POSITION | | | | |
|---|---|---|---|---|---|
| LETTER | First | Second | Third | Fourth | Fifth |
| A | 1.9c | c4.1c | c2.7c | c2.6c | c1.7 |
| B | 1.7v | v1.8v | c .7v | v .3v | v .2 |
| C | 2.1v | v .4v | - .8v | v1.2v | v .5 |
| D | 1.1v | v .2- | v1.0- | v .7v | v1.1 |
| E | .7c | c3.1c | c1.8c | c3.5c | c4.1 |
| F | 1.2v | v .1- | v .3v | v .3v | v .2 |
| G | 1.2v | v .1v | v .9- | v .8v | v .3 |
| H | .9v | c1.4c | - .3v | c .4v | c1.2 |
| I | .4c | c2.6c | c2.5c | c2.3c | c .4 |
| J | .4v | v *v | v .1v | - *v | v * |
| K | .5v | v .2v | v .3v | c .6v | v .8 |
| L | 1.2v | -1.7c | c1.6c | c1.6v | v1.6 |
| M | 1.4v | v .4v | c .9- | v .8v | v .7 |
| N | .6v | v .8c | v1.8c | v1.8v | v2.0 |
| O | .6c | c3.4c | c2.1c | c1.7c | c .9 |
| P | 1.6v | v .5v | v .7v | v .6v | v .5 |
| Q | .2v | v .1v | v *v | v *v | 0 |
| R | 1.0v | v2.4v | -2.4c | c1.6c | v1.9 |
| S | 3.5c | v .3- | v1.0c | -1.6v | c1.6 |
| T | 1.7- | v .7v | c1.3- | c1.5v | c2.3 |
| U | .5c | c2.3c | c1.5c | c1.3c | c .2 |
| V | .6v | v .1v | v .6v | v .4v | v * |
| W | .8v | c .3v | v .3— | v .2c | v .2 |
| X | *v | v .1v | v .2v | v *- | v .2 |
| Y | .2v | c .4v | - .4- | - .1c | c3.4 |
| Z | .1v | v .1v | v .2v | v .2v | v .1 |

Numbered entry = % of statistically probable appearances of letter in position, where probability = U/26, U = universe of words of 5 letters, 26 = letters in alphabet.
* = appearances less than 10% of average.
Lower case letter indicates most frequent category in preceding or following position. Stub letter on left indicates particular letter to which entries refer. (If no lower case letter appears but space is occupied by a dash (-), there is no preference as to vowel or consonant in that adjacency. If lower case letter is underscored, there is no alternative to use of that category.)

Thus, if the information in the AP Table reads "v2.3c", one knows that no consonant can precede the stub letter in a word of the length in question, when that stub letter is located at the position where that information is read. One knows also that the stub letter will appear in that position, over twice as many times as the average letter will appear in that position, a consonant will be found more often than a vowel. If the information in the AP Table reads "c1.8-", one knows that either letter may precede the stub letter in the position shown at the column head, with a consonant more often than a vowel; that the stub letter will be found in that position one and eight-tenths times as often as the average letter will be found there, and that there is practically no difference in the frequency of appearance of a vowel or a consonant in the following position. It is noted that the appearance frequencies are based on counts of letters in the "Basic Paralogs" developed as a part of the present invention.

With this explanation of the AP Tables, illustrations of how they are used in the present invention are presented below.

One needs to know before placing a bleed run in a given position of a framework, that each of the letters in the bleed run will be so located in their intrasectional derivatives (those words which do not bleed out, and which share letters with the bleed run), that they can be carried by such derivatives. As an example, if the bleed run has a "Q" in it which would occupy the fifth position of a five-letter vector path, the question is whether a five-letter word exists with a terminal "Q", and if so, what is the preferred letter category (vowel or consonant) to preced it in the fourth position of the five-letter vector path. A check of the five letter APT shows "0.0". There is no five-letter word which ends with "Q", which appears in the developed "Basic Paralogs". One could possibly get around this with "SUZY-Q", but such would not be generally acceptable. The proper spelling of that pre-World War II dance includes the hyphen, which is not used in crossword puzzles. Without the hyphen it would appear as "SUZYQ".

Suppose it is not a "Q" one is hunting, but a "T" instead. The "T" in the stub column of the five-letter APT is found in the table reading across to the fifth position, finding "c2.3". The letter "T" will appeal as the terminal of a five-letter word almost two and a third times as often as the average letter of the twenty six letters of the alphabet.

Figure 5:
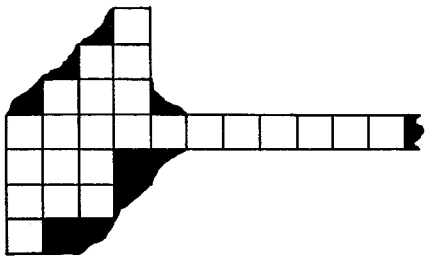

Suppose one's section is drawn so that the bleed run will cut across it at different positions of intra-sectional words as is shown in FIG. 5.

If one were hoping to put the word "PTERODACTYL" into that bleed run, one would find the first two letters and the fourth letter of PTERODACTYL in the AP Table for four-letter words, and the E (the third letter) in the five-letter AP Table. None of the values is too low to use, so as far as the letters PTER with which the word begins, one would have no problem.

There is another way one can use the APT of the present invention. Suppose one had a section into which there is already laced a generator word, and one now wants to find its principal derivative for that puzzle. One is not concerned with what the word should be, assuming that it is not a topical puzzle being created. The section before placement of the principal derivative would look like that shown in FIG. 6, and the principal derivative is of course the vertical letter run at 4-D. It has already been noted that its vector path is immaterial, but because one wants to make sure there will be no problem with the establishment of vector controls for the section, one should go to the highest values one can find in the AP Table and draw a word from those highest valued letters. Anagrams can be played with those, to come up with an easy bleed run to fill from.

To do this, one goes to the four-letter AP Table and rearranges the terminal values for the letters in descending order rather than the alphabetical order of the table:

| | | | | | | | | | |
|---|---|---|---|---|---|---|---|---|---|
| E | c3.5 | L | v1.3 | R | v1.2 | G | v .6 | Z | v .2 |
| A | c3.0 | Y | c1.3 | K | -1.1 | B | v .5 | C | v .2 |
| T | v2.0 | I | c1.3 | H | v .8 | F | v .4 | Q | v .1 |
| O | c1.7 | D | v1.3 | M | v .8 | W | v .3 | J | c * |
| N | v1.5 | S | c1.2 | P | v .8 | X | v .2 | V | v * |

-continued

| | |
|---|---|
| U | c .7 |

Now, noting that the seven-letter principal derivative has an E in fifth position (which need not be considered in calculation of values), one determines what can be done with _ _ _ _ E _ _, and the higher value letters of this rearrangement. The twelve which have a value greater than average (i.e., more than 1.0) suggest the words "ENTREAT", "TENTERS", and "LETTERS". These alternatives require that one look up a value for the first letter of a four-letter vector (the "A" of "ENTREAT" and the "R" of "TENTERS" and "LETTERS"), and the fourth letter of a five-letter vector (the second "T" of "ENTREAT", the "S" for the other two words). These alternatives produce for this particular configuration, the following values:

| | | | | | |
|---|---|---|---|---|---|
| E | c3.5 | L | v1.3 | T | v2.0 |
| N | v1.5 | E | c3.5 | E | c3.5 |
| T | v2.0 | T | v2.0 | N | v1.5 |
| R | v1.2 | T | v2.0 | T | v2.0 |
| E | — | E | — | E | — |
| A | 2.1c | R | 1.1v | R | 1.1v |
| T | c1.5v | S | —1.6v | S | —1.6v |

Not one of these is unfavorable. The highest sum appears by adding the numbers after ENTREAT, which gives 11.8; TENTERS is next with 11.7; the word LETTERS is lowest in total at 11.5. There is no significant difference; any of the words would serve as principal derivative for the configuration in question.

There is a caution to be noted with respect to these alternatives: the preference (lower case) letters which precede ENTREAT would set up a five-letter vertical vector at 3-D in the figure, reading CVVC (the terminal consonant being the N of GENERATOR). For the other two words that vector would read VCVVC. As noted below, both of these vectors CVVVC and VCVVC, will appear less frequently than will the average five-letter vector, and that the second of the two is used more often than the first.

It should be noted also that none of the preference categories is underscored. This means, of course, that one is not forced into the use of either category, vowel or consonant, at any place in the vertical vector at 3-D (other than the N of GENERATOR, of course), but can use whatever suits ones needs in optimizing the arithmetic value for the section.

In general one should not rely on the preference letters of an APT determination to set the parallel vector path, without first checking to see what that setting would produce as a vector path value.

In the present invention "Y" is treated as a vowel. So, in the hyphography of the present invention, the vowels are A, E, I, O, U, and Y; all the remaining letters being consonants. Even though these six vowels make up only 23% of the alphabet, their combined use frequencies take up about 43% of the spelling burden in American English. This is a fairly close to an even split between vowels and consonants. And, since the public all lives with the division of the alphabet into these two categories from elementary school forward, it is quite a convenient one as well.

Every word in an alphabetic language which has the two categories, vowel and consonant, has to follow a vowel and consonant vector path, by definition. Only a very few languages use written alphabets without vowels (Hebrew is one example of the exception). In the English language, a word may be a lone traveler along its vector path; the word ANGST shows no companions. Some words share a path with a substantial percentage of all the words of a given length, as do the five-letter words in "TOWER of BABEL". Their vector path, CVCVC, accommodates about 32% of all five-letter words. As for the usual length words which predominate in crossword puzzles (i.e., five-, four-, and three-letter words), most all the vector paths are used. The longer the vector path, the lower the percentage of paths that are used, but this phenomenon only commences with the five-letter words. The five-letter vector paths VVVVV and VVVVC are not occupied; until someone introduces new words which follow those two paths, one cannot use them in establishing vector controls for a hyphos. All the remaining paths for three-, four-, and five-letter words do have one or more occupants, as will be seen.

The knowledge of vector paths is used in the present invention to locate swiftly desired words. The hard-to-find words are located first, if they have to be used; those paths are skipped if they don't. Used words are easily found on frequently-used vector paths. For this, vector paths of three-letter words, four-letter words, and five letter words are indexed below:

THREE LETTER VECTOR PATHS

| Path | Frequency | Path | Frequency |
|---|---|---|---|
| VVV | .12 | CVV | 1.21 |
| VVC | .42 | CVC | 3.80 |
| VCV | 1.02 | CCV | .50 |
| VCC | .75 | CCC | .18 |

FOUR LETTER VECTOR PATHS

| Path | Frequency | Path | Frequency |
|---|---|---|---|
| VVVV | * | CVVV | .22 |
| VVVC | .09 | CVVC | 2.22 |
| VVCV | .29 | CVCV | 4.90 |
| VVCC | .15 | CVCC | 3.54 |
| VCVV | .33 | CCVV | .36 |
| VCVC | 1.22 | CCVC | 1.62 |
| VCCV | .86 | CCCV | .02 |
| VCCC | .12 | CCCC | .01 |

(* = Less than 01%)

FIVE LETTER VECTOR PATHS

| Path | Frequency | Path | Frequency |
|---|---|---|---|
| VVVVV | 0 | CVVVV | .05 |
| VVVVC | 0 | CVVVC | .32 |
| VVVCV | .03 | CVVCV | 1.31 |
| VVVCC | .05 | CVVCC | 1.11 |
| VVCVV | .04 | CVCVV | 1.06 |
| VVCVC | .39 | CVCVC | 10.40 |
| VVCCV | .14 | CVCCV | 4.82 |
| VVCCC | .04 | CVCCC | 1.23 |
| VCVVV | .02 | CCVVV | .02 |
| VCVVC | .47 | CCVVC | 1.52 |
| VCVCV | 1.16 | CCVCV | 1.98 |
| VCVCC | .55 | CCVCC | 2.66 |
| VCCVV | .26 | CCCVV | .06 |
| VCCVC | 1.84 | CCCVC | .20 |
| VCCCV | .23 | CCCCV | .01 |
| VCCCC | * | CCCCC | * |

(* = Less than 01%)

It should be noted that the number of paths in each of these tables doubles each time one adds a letter. The formula for calculating the number of paths of any length word is $2^n$, where 2=number of categories (vowel, consonant), and n=number of letters in the word length.

In the above tables, the number given alongside each vector path represents a percentage relation to the average number of words for all vector paths of the given length. So, since one has eight paths for three-letter runs, and in the universe used there are 1,532 words in three letters, the average vector path will have 192 words. Using 192 as the average and setting it equal to 1.00 (100%), then a vector path which has an actual number of words equal to 81 will show a vector path value in the table equal to 0.42, or 42% of the average. The four-letter words are also totaled and that total is divided by 16, since there are 16 vector paths of four-letter length. The total number of five-letter words is divided by 32 rather than by 16, because there are that many vector paths for five-letter words. These averages are in each case converted to 1.00, or 100%. All other vector path values take their proper places in relation to the average value of 100%, for the length in question.

This allows one to compare the difficulty or ease of finding a three-letter word with the difficulty or ease of finding a four-letter or a five-letter word, as that difficulty is in each case measured by the use frequency of their respective vector paths. Then, with such a comparison, one can optimize an entire section's vector paths, to get the largest practical value for all the words in the section regardless of lengths or total words of a length. The reasoning goes thus: Because a puzzle is two-dimensional, one cannot use the largest vector path numbers for every word. The horizontal requirements conflict with the vertical ones. So, before one looks for words, one should figure which layout of vector paths will give the highest practical total of vector values in both directions, and thus the longest practical lists of words, both horizontal and vertical, to draw from. This is measured much the same way as was done with APT values, but here the measuring device differentiates between use frequencies of vector paths.

Each letter placed in a section of any crossword framework, wherever it may fall in either of its individual words, will have a referred impact on every other letter-square in the section. Two letters placed at random in a section, without the words of which they will become a part, may or may not be compatible with each other in the two locations in which they are placed. And, as the letters accumulate in a section by the placement of words, the derivative limitations of their placements will increase on the remaining letter runs, restricting more and more what can be placed in those letter runs. Taken to the extreme point, one could fill in words in a section until one had but one letter square left blank, and only one letter to fit that pair of vectors which join there.

The problem which would-be crossword crafters have is taking their placements beyond that point. They fill in words without enough thought to the increasing restrictions which those fill-ins are placing on the remaining unfilled letter runs. Soon they reach the stage where there is no word left which can fit one or more unfilled runs, because the words which must share letters already placed do not exist. Nor is this surprising: dealing only with words of three, four and five letter lengths, there is only one chance in one thousand that there will be a word having a particular letter in the position where it is needed. This is the point at which the total inventory of words enters the picture as a primary consideration.

It goes without saying that the larger the word inventory the more certain the availability of a word. From this, it follows that if one has two letter runs to fill which, when filled, will share a letter at a given junction point, that one run of the two which has the least number of available words should be the first one filled. This follows the golden rule of completing the most difficult task first. By extension of the reasoning, if one can in some way assure oneself that one will at all times have the largest possible word inventory available for every letter run, one's task will by the same token have been made as easy as one can make it.

This assurance is provided by optimization of vector path values in a puzzle—setting up a pattern to follow which has a statistical basis in high probability vectors, and selecting words which follow that pattern. Before one even thinks about specific words to fill in around the generators and other bleed runs, one must structure the framework topography in terms of high statistical probability.

Even a single word more in an inventory might make the difference between a completed puzzle section and one that can not be completed. So, once the bleed runs have been entered and one is at the point where the only consideration is to fill out the rest of the section, vector controls to be followed are established: choosing from the proper word lengths, those vector paths which in combination will give the highest numerical value when tallied both horizontally and vertically, for the section as a whole. This make the statistics work in favor of completion.

This selection process is called optimizing rather than maximizing, because of the presence of the bleed runs and the possibility of priority inserts. Given a completely blank grid of whatever size, there is likely but a single maximum value which can be reached in distribution of vowels and consonants in accordance with observed frequencies in actual word use. The likelihood that such a maximum value would coincide with the letter distribution of the bleed run placements made is mimimal. So, given the limitations of bleed runs insertions and priority word insertions (as in a topical puzzle), one produces the highest arithmetic value one can; thus optimization.

(This of course implies that a priority insert required by a topical puzzle or otherwise should be treated the same way as a bleed run, when it comes to establishing vector controls. It should receive the same consideration as a principal derivative receives, and at the same time—it must be inserted before one begins to calculate vector path frequencies.)

When one has completed the vector inserts for a section, they are tallied horizontally and vertically, then the result is divided by the number of vector paths used to arrive at that total. This gives the average vector value for the section as a whole. The process is repeated for each of the sections in the entire puzzle. The lowest total for all the sections is to be given the number "1", to indicate first priority when one is ready to start filling in words to replace the vectors. The next lowest section total is given the number "2", then "3", and so on. In this way, one establishes the section priorities for the skeleton, such as the "tic-tac-toe" skeleton shown in FIG. 1C for that hyphos first discussed, and illustrated in FIG. 1B.

Figure 7B:
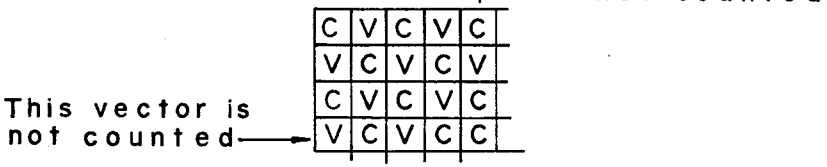
Figure 7A:
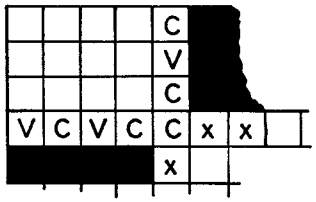

Suppose one has a puzzle section which has the confirguration shown in FIGS. 7 A&B. The incompleted tails in FIG. 7A represent bleed runs with which one need not be concerned; it shall be assumed that they are already filled in with a generator and its principal bleed derivative, each having the vector path portions shown in FIGS. 7 A&B. What is important are the vowels and consonants in those two bleeds; as each of them terminates a letter run in the section of FIG. 7 A&B.

One goes to the Vector Path Tables above and the selection provides the matrix like that of FIG. 7B (tails deleted). Taking the vertical vectors and then the horizontal vectors the following figures are computed: 4.90+1.22+10.40+1.16+10.40 for a total of 34.20 and an average of 4.89. This is an extremely good average: anything around 3.00 or above for words of the lengths involved will generally be easy to work with in later stages of crafting the puzzle. Even so, one should still consider whether there is any way to raise the total and the average still higher.

Checking the vertical vectors, the two which read VCVC are prime targets; the two which read CVCV cannot be raised at all, since 4.90 is the highest valued four-letter vector path in the table. By changing the initial letter of the second or the fourth vertical vector to a consonant, one could raise its value to 1.62. That change, however, drops the top horizontal vector to 0.20 if the second vertical is the target, and to 1.23 if the fourth vertical is modified. That means a loss of 9.38 from the total in the first case, and a loss of 9.17 in the second; neither of these offsets the gain of 0.40 made by changing the vertical vector's intial letter. Similarly, changing the horizontal vector second from the top, VCVCV would allow an increase in the horizontal vector path totals, but the increase in each case is more than offset by the drop in the values of the vertical vectors.

Suppose one has a priority word insert which must be made. That, of course, is a different question from that of value. If one has a puzzle theme and must use a specific word having the vector CCVC, both the second and the fourth vertical vectors should be considered in this section. One may be able to use the topical word in either of these places, and still have an average of 3.54 or 3.58 for the section, depending on which of the two vertical vectors reading VCVC is replaced (the priority insert may not fit in one or even either of the two locations, however, one can't throw it into either place simply on basis of the fact that it has a higher value than the 1.22 shown in the sample). One needs to remember that in preparing a hyphos, a priority insert is to be handled the same way one handles a bleed run—it is placed before the vector determination is commenced and it is coordinated with the other section inserts of the bleed runs to the extent possible at the earliest stage.

One also needs to remember that when vector path questions have been determined, one searches for individual words in the provided "Basic Paralogs" in reverse order of the size of vector path values for all runs in the section. This is particularly significant when dealing with hazard letters, which shall be considered presently.

As practice exercises in using the Vector Path Tables above, assume one has no priorities other than bleed run placements. One would then go to the tables above to find high value vector paths, and insert them in the various letter runs in these sections as if they were going to use those paths as vector controls. When this is done, the vector path values for all the paths inserted or completed are added up (one letter of each path is a part of the assumed bleed run). Only completed vectors are counted. Then the totals are divided by their number of vectors in each case to get an average value for the section.

There is one other consideration involved in respect of the materials gone over thus far; that is the resolution of conflicts between a non-APT-determined bleed run (usually a generator) and the intra-sectional, derivative vector paths which will extend from that bleed.

So far as vector paths are concerned, a blank grid with its bleed runs inserted such as appears in FIG. 7A, may readily enough be opitmized as has been indicated. But suppose the horizontal bleed run of the section contains one or more letters of extremely low APT value? Do the vector path values, determined solely on the basis of the vowel and consonant inserts of the bleed, still constitute the optimum inserts?

The answer is, not necessarily. As a general rule, this will make no difference. The vector path values are chosen so as to insure the maximum, practically available, word inventory. In specific cases, however, it might make a difference. It depends on the letters in the bleed run, rather than on the category into which they fall. Refer, for example to the four letter Table of Average Preference Values, fourth position, and the stub letters, J, Q, V, and Z. The APT figures are so low that those letters constitute a potential hazard to the section structure shown in FIG. 7A.

That section FIG. 7A was optimized from the standpoint of vector values generally. The specific case, in which either the second vertical letter run, or the fourth vertical letter run, contains one of those hazard letters, places the entire matrix in question. Narrowing the focus, is one of the four letters J,Q,V, or Z, contained at the foot of the vertical second or fourth vector? If so, is there a word in the provided "Basic Paralogs" (or any other source one may have) which matches the optmized vector VCVC, and has that letter in fourth position? If there is such a word, fine; the problem is minimized and can likely be handled, but one must nevertheless treat the letter run which would terminate in that hazard letter as a priority insert. (This is necessary because the choice of intra-vector letters which terminate in that hazard letter, is limited to those which one finds in the few words using that hazard letter.) So one locates those words which contain that hazard letter. One word is chosen and inserted in the section, and the remaining portion of the section is then maximized. On the other hand, if there is no such word, one has caught at the very inception of the work, the fact that the negative cannot be overcome. One of two things must be done: the bleed run must be changed, or the optimization pattern for the section must be set to accord with what is possible. If time is of primary consideration, one would do better by changing the bleed run than by accommodating the derivative vector path to the hazard letter. The point is that a hazard letter indicates a hazard word which must be treated as a priority insert in the system of the present invention.

Naturally not all these situations will arise when the hazard letter appears in terminal position of a four letter word as shown in the illustration. The four letter APT values show hazards, identified by asterisk, at ten different positions. It shows two potential hazard positions by the low value of 0.1. Similarly-determined hazard positions appear in the five letter APT table. Any time a hazard letter shows up in one of those positions, by reason of a bleed run insert, one has a situation which requires priority attention. It won't take long for one to fix in mind hazard letter positions, so that checking will become unnecessary. (An additional help with respect to hazard letters will be found in the PAR Tables below.) While it has been found that a hazard trigger point of 0.1 is adequate for purposes of the present invention, one may wish to set it at a different level.

The letter "Y" at the initial position of any vector path must be regarded as a hazard letter. Its dual nature (consonant and vowel, depending on usage) requires that even though in vector path calculations it is treated herein as a vowel, and even though its APT value is above 0.1 in all positions but one of those appearing in the tables, in initial positions it must be regarded as a hazard letter.

Unless the initial "Y" is to be followed by a vowel, the hazard of infrequent use is present. On only five vector paths of the above tables does it appear in initial position followed by a consonant: VCV, VCCV, VCCC, VCVVC, and VCCVC. And its appearance on those paths is infrequent. For this reason when one enters a bleed run that displays a "Y" which is also the initial letter of any derivative vector, one will on most occasions want to make the second letter of that derivative vector path a vowel rather than a consonant.

The PAR (Position Acceptance-Rejection) Tables which are given below are primarily provided as a matter of completeness and can be useful but are not absolutely necessary in crafting crossword puzzles.

When one gets to making "topical" puzzles as they are known to the trade, one will be setting down a number of words as a specialized inventory. One will want to use as many words as possible from that inventory. The vectors for those special words may or may not fit a previously prepared working matrix. The fall of a given letter of one of those special words may be a sharing position of a vector path when there is no word of that vector which carries that letter in the shared position.

As noted previously, one should treat such a specialized word as a priority word, and insert it before the vector paths are filled in to make a hyphos complete. It is believed that for most purposes one will be able to make a fully satisfactory "topical" puzzle in that manner.

The committed theme words of a topical puzzle can for some editors constitute as few as 10% of the total number in the puzzle; some editors require 20%, others require 35% and on occasion one may find up to 40% of the words all centering around the committed theme. The majority of the words in American English are multivalent (i.e., they can be defined in more than one way). Because of this, it is often a simple task to define a word in such fashion that it is related to a selected theme, even though one did not have it in the specialized inventory of words one wanted to use.

On the other hand, if certain of the special words must be used, and the result would be a puzzle with an odd letter which would foul the crossing optimal vectors, the PAR tables are designed to help one in setting it up. One has a priority insert word here, and whether it was gotten because of the presence of a hazard letter at some position in the word or whether it got there from a required topical word is of no moment; the considerations are the same.

In the PAR tables illustrated at pages 60 through 63 of the book entitled "The Crossword Word Master: Hyphography With Appendix of Basic Paralogs" by the inventor, Paul L. Wayman, (registered with the U.S. Copyright Office on Aug. 30, 1978 as TX 79-809), which is incorporated herein by reference, the vector path is given in the left hand, stub column. Across the top of the table appear letter position numbers for the remaining columns of the table, just as they show in the APT tables. In each column of the PAR however is a series of boxes. When the stub-designated letter calls for a vowel in the position shown in the column number, the box will carry one to six letters, all of them being vowels. When the stub-designated vector calls for a consonant in that position, the box will contain from one to 20 letters, all of these being consonants. The letters contained in a box of the PAR table are the only ones which one can expect to find at that position of the vector indicated.

The PAR tables are derived from the "Basic Paralogs" developed in the present invention. In this connection, one should be aware that the English language adds about a hundred new words each month, while another hundred fall into disuse. The realtively unchanging core of words, plus those more transient but sufficiently fixed to be included in one or more of eight different American desktop dictionaries, have been incorporated by selection in the "Paralogs" hereof.

By reason of changes in usage, changes in the "Paralogs" are to expected. It is not likely that major changes which would modify the respective positions of APT or Vector Path values will occur, although there could easily be additions to the PAR appearances.

So far as high-valued vectors are concerned, a vowel is already shown in the PAR tables 93 times out of every 100, and a consonant will appear 83 times out of every 100. These reflect the odds of finding a sought-after letter in a high-valued vector. And, so far as the low-valued vectors are concerned, the "Paralogs" provided can be scanned almost as rapidly as the PAR tables, so that reaching the "Paralogs" through the PAR tables constitutes an extra stop which may be unnecessary. For these reasons, the PAR tables are seldom resorted to.

An exemplary list of "Paralogs" for "S" through "T" for four-letter words having the vector CCVCC is presented below:

| | |
|---|---|
| SWONK | TRUNK |
| SWORD | TRUSS |
| SWORN | TRUST |
| SWUNG | TRUTH |
| THANK | TRYST |
| THANT | TWANG |
| THEFT | TWILL |
| THEGN | TWIRL |
| THERM | TWIRP |
| THEWS | TWIST |
| THICK | TWIXT |
| THIGH | WHACK |
| THILL | WHANG |
| THING | WHARF |
| THINK | WHELK |
| THIRD | WHELM |
| THIRL | WHELP |
| THONG | WHICH |

-continued

| | |
|---|---|
| THORN | WHIFF |
| THORP | WHIRL |
| THOTH | WHIRR |
| THUMB | WHISH |
| THUMP | WHISK |
| THURL | WHIZZ |
| TRACK | WHOLL |
| TRACT | WHOMP |
| TRAMP | WHORL |
| TRANS | WHORT |
| TRAPS | WRACK |
| TRAPT | WRAPT |
| TRASH | WRATH |
| TRASS | WRECK |
| TRAWL | WREST |
| TREND | WRICK |
| TRENT | WRING |
| TRESS | WRIST |
| TREWS | WRONG |
| TRICK | WROTH |
| TRILL | WRUNG |
| TROLL | |
| TROTH | |
| TROTS | |
| TRUCK | |
| TRULL | |
| TRUMP | |

Game Embodiment

The preferred game embodiment of the present invention includes a game board 10 such as that shown in FIG. 8A which has a square grid overlay on the board's upper surface, each playing square of the grid marked with either a "C" or a "V" (for consonants and for vowels respectively) for placement of a corresponding playing piece; magnetic means for sorting playing pieces after a completed game; the playing pieces 20 (FIG. 8B) each of which is marked with a letter of the alphabet on its face and blank on the opposing surface of that piece; and sets of cards and markers used in play and scoring the game, namely "pecie" cards, "Area Bond" cards, "Letter Certificate" cards, "Bossword" cards, and scoring sheets.

The game board 10 is generally flat and composed of a material to which magnets adhere. A grid of lines 11 is formed on the game board upper surface of a magnetically transparent material by painting, printing, film overlay, or similar means. The grid forms an exemplary 225 small square areas of, for example, 15 millimeters by 15 millimeters in a 15 row by 15 column arrangement which constitute spots for placement of playing pieces 20 or black spots 30 for separation of rows and columns into various word-length segments. The playing pieces 20 are of two classes, each identical in size and shape, but differing in marking and in magnetic properties. They are approximately four millimeters in thickness and 15 millimeters by 15 millimeters square such that each piece exactly covers one small grid area on the game board. The classes of pieces 20 are:

(a) those marked on their upper sides with a vowel letter and having an incised "V" or indented on the obverse or undersides, and without magnetic properties (this class includes the letter "Y" for purposes of this disclosure), and (b) those marked on their upper sides with a consonant letter having an incised or indented "C" on their obverse or undersides and being magnetic in nature.

The effect of the magnetic and non-magnetic properties of the two classes of pieces is that during play, the consonant class is readily retained by the magnetically attractive game board, facilitating the arrangement of both consonant-marked pieces and any adjacent vowel-marked playing pieces during play, and resisting disarrangement should the game board be moved. The sorting of the pieces at conclusion of the game is accomplished by holding the board inverted and allowing the non-magnetic class of pieces to fall from the board whence they are gathered. The board is restored to its surface-up position and the magnetically-retained playing pieces are thence gathered.

The effect of the incised or indented areas 21 on the playing pieces is to control the proper placement of "C" playing pieces 20 on "C" squares only and "V" playing pieces 20 on "V" squares only by means of having corresponding raised portions 21 on the game board 10 (note FIG. 8B) for mating therewith. Blank playing pieces, that is pieces having no letter (vowel or consonant) on their upper sides, which can for example be black on their uppersides are also provided and have superimposed "V"s and "C"s incised on their lower, obverse sides, allowing them to be placed on either a "V" or a "C" square in cases of impaction, etc., or to change an over-all grid pattern.

The game configuration is composed of an arrangement of an exemplary playing surface (note FIG. 8A) which is designed to optimize the completion of a word array, with a probability for the playing surface graded into for example easy, moderate or hard. In addition, other configurations and other grades of difficulty may be devised by rearranging the black spots and the designations for placement of vowel letters and of consonant letters.

The crossword array is formed by interlocking rows and columns of "C"s and "V"s separated into distinct linear placement areas by the black squares 30, or by a black square 30 in combination with the playing surface perimeter 12. Each linear segment of a row or column between two black squares 30 or between the playing surface perimeter 12 and a black square 30 is a line for occupancy by a word or letter combination such as might be found in a crossword puzzle.

The playing surface is mathematically programmed to optimize and grade the chance of successfully filling every linear segment, provided that only consonant letters be placed on "C" spots and only vowel letters be placed on "V" spots, in the circumstance that the playing pieces are drawn at random from separate pools of vowel pieces and of consonant pieces in statistically-determined mixes in accordance with their frequency for use in linear segments of the lengths provided in the array. The area 13 outlined in red in the drawing constitute areas for initial "Bossword" words of the correct consonantvowel pattern to be filled in prior to play from a set of appropriate words on a set of Bossword cards supplied with the game or available in additional sets. These "Bosswords" are utilized to connect the several word placement areas of the playing board, and provide primary letters for formation of rightangle words or letter combinations in play.

The playing surface is divided into four color areas (not related to priority areas)—e.g., blue 14, yellow 15, green 16, and red 17—to establish competitive strategy as well as to aid in scoring play as described below. The object of the game, aside from the completion of a crossword array, is the accumulation of points or "pecies", by playing lettered playing pieces, and by completing a linear segment, within the boundaries of any word placement area, and by exchanging "pecies" for "Area Bonds" which appreciate in value as the area of their color fills with playing pieces. Additionally "Letter Certificates" which are fixed in score values are used. The winner is the player with the greatest number of points at game's end.

The score a player earns completing a linear segment is printed adjacent the end of the linear segment, either at the corresponding terminal black spot 30 or on the periphery 12 of the board. Thus the score for a player completing the vertical linear segment 18 is thirty; while for horizontal linear segment 19 the score is ten. Play proceeds according to the following exemplary rules:

consonant letter playing pieces may be played only on "C" spots; vowel letter playing pieces may be played only on "V" spots; words may be placed only in a row or column within a playing area.

words formed must run from the playing surface perimeter to a black square or from a black square to a black square and must conform to the "C - V" pattern of the row or column;

speculative placements are excepted from the last rule, speculative placements being a partial play on a linear row or column allowed (but not required) after a player has completed one or more row or column segments and has playing pieces still unplayed; the unplayed pieces must be placed conformably to the playing surface pattern on any incompleted linear segment.

time limits agreeable to all players equalize the beginner and the experienced player;

play proceeds in the clockwise direction;

all players draw from the consonant playing piece pool to determine who shall start the play, the letter nearest in order to the letter "A" begins;

four initial words are drawn from the stack of "Bossword" cards and playing pieces spelling them are placed in the appropriate (marked red) areas of the playing surface;

each player draws five vowel pieces and seven consonant pieces and places them face up in view before him, "Y" being considered a vowel;

up to six pieces may be used in one play and more than one row or column may be completed;

pieces played are replenished after each turn so that the player always has five vowel and seven consonant pieces;

any word that could be found on a crossword puzzle is a legal play, including abbreviations, acronyms, and foreign words;

after his first play, any player may purchase colored "Area Bonds" for points "pecie" earned, bond value is based upon the number of uncompleted spots in a color area and is shown on the bond face;

points are earned by completing a row or column, the number of points earned is indicated in the black square or marginal space following the terminal square of each row or column;

speculatively placed pieces, if not used to complete a word within two rounds of play or within two rounds of game termination, may be removed by a player and replaced with another letter, credit for the pieces thus used is for the player using the square(s) to complete a word;

for each piece placed, including speculative placements, the player receives one "Letter Certificate" equivalent in value to fifty "pecie";

if a player cannot make a play within the time limit agreed upon, he must announce "no vector" and each player has fifteen seconds in turn in which to say the same or announce "override", in which latter case he must complete a word from the original player's stock of pieces, the "pecies" for completing the word going to the overrider and the "Letter Certificates" for the pieces placed going to the original defaulting player; if the player announcing an override fails to make a word, he defaults his highest value bond to the house;

if no override is announced, the original player may restock any six of his pieces by draw or make two speculative placements and restock four pieces or pass his turn;

if a player exceeds his time limit without playing, the game proceeds as if he had announced "no vector";

before a turn has passed, placement may be challenged for location or context, if the challenge is not overcome the challenged pieces must be removed and count toward the six per turn;

two unmet challenges end the player's turn;

a context challenge is overcome by proving the word by authority, a book of "Paralogs" or a dictionary for example;

a location challenge is overcome by proving that the lettters placed do not create an impaction, i.e., a situation where letters already accepted must combine with the challenged letters in a word not yet complete and that combination of letters makes the completion of the word impossible; to prove no impaction, the player must prove that a suitable word using the existing letter(s) and the challenged letter(s) in the manner played does exist; it is noted that in a situation in which two vectors in close proximity to each other are filled with such letters that while acceptable derivatives may be extended from each of them, the placement of some derivative of one must necessarily impact some derivative of the other - the placement which creates this situation (called a "sport") is not subject to location challenge;

An impaction is cleared by placing a blank playing piece at some point on the impacted linear segment; neither of the linear segments on which a blank playing piece appears may be scored;

Derivative (right angle) words of a sport may only be played by treating the impaction before a placement is made; and game ends on the twenty-seventh or twenty-eighth play depending upon whether the number of players is odd or even; and the player with the highest score, that is the sum of unspent "pecies", value of "Letter Certificates", and appreciated "Area Bonds", wins.

Because many varying and different embodiments may be sure within the scope of the inventive concepts herein taught, and because many modifications may be made in the embodiments herein detailed in accordance with the descriptive requirements of the law, it is to be understood that the details herein are to be interpreted as illustrative and not in a limiting sense.

I claim:

1. A crossword puzzle game comprising:

an at least generally flat playing surface game board having "C"s and "V"s indicia located on various playing surface areas on said game board;

grid means for dividing said playing surface into a plurality of rows and columns definintely delineating said playing surface areas;

a plurality of vowel playing piece means at least similar in size and shape to the "V" playing surface areas for placement on said "V" playing surface areas.

a plurality of consonant playing piece means at least similar in size and shape to the "C" playing surface areas for placement on said "C" playing surface areas.

marking means on the upper surfaces of said playing piece means for marking each with a letter of the alphabet, the vowel playing pieces with a vowel of the alphabet and the consonant playing pieces with a consonant of the alphabet, said "C"s on said game board forming consonant identification means on certain playing surface areas identifying them as spots for placement of playing piece means marked with a consonant letter and said "V"s on said game board forming vowel identification means on certain other playing surface areas for identifying them as spots for placement of playing piece means marked with a vowel letter.

blank area means on the remaining playing surface areas for identifying them as spots upon which no playing piece means may be placed and constituting blank areas dividing the playing surface into section areas for placement of playing pieces and areas in which no playing piece may be placed;

the game further including the following rules:

(a) the rule that consonant letter playing piece means may be placed only on playing surface areas constituting spots for occupancy by consonant letter piece means;

(b) the rule that vowel letter playing piece means may be placed only on playing surface areas constituting spots for occupancy by vowel letter playing piece means;

(c) the rule that playing piece means shall be placed on board areas so as to completely fill a linear row or column segment between a playing surface perimeter and a blank area or between a blank area and blank area to form a word; and (d) the rule that playing piece means may be placed so as to spell a word such as might be found in a conventional crossword puzzle.

2. The game of claim 1 wherein:

said game board has limited portions thereof at a level different from that of the main surface area of said playing surface, said limited portions forming said "C"s and "V"s indicia; and said vowel letter piece means carry limited portions of a vertical level different from that of the surrounding areas forming "V"s on their lower surfaces which match and mate with the "V"s formed on said game board; and said consonant letter piece means carry a limited portion at a vertical level different from that of the surrounding areas forming "C"s on their lower surfaces which match and mate with the "C"s formed on said game board; the presence of said "V"s and "C"s on said game board and said playing piece means resisting the placement of consonant letter piece means on "V" playing surface areas and vice versa.

3. The game of claim 2 wherein the "V"s and "C"s on said game board are raised while the "V"s and "C"s on said playing board are incised.

4. The game of claim 1 wherein there is further included a plurality of blank playing piece means at least similar in size and shape to both the "V" and the "C" playing surface areas for placement on either said "V" or "C" playing surface areas, said blank playing piece means carrying limited portions of a vertical level different from that of the surrounding areas forming "C"s and "V"s on their lower portions which match and mate with both the "C"s and the "V"s on said game board.

5. The game of claim 1 wherein there is further included scoring indicia means on the playing surface located at the terminal area of each row or column segment and outside of said segment for assigning a number representing points earned for completion of that segment.

6. The game of claim 1 wherein said game board is made up of a magnetic material and the playing piece means of one kind are also of magnetic material, while the other kind is not.

* * * * *

UNITED STATES PATENT AND TRADEMARK OFFICE

CERTIFICATE OF CORRECTION

PATENT NO. : 4,205,852
DATED : June 3, 1980
INVENTOR(S) : PAUL L. WAYMAN

It is certified that error appears in the above-identified patent and that said Letters Patent are hereby corrected as shown below:

Column 2, line 37, "V⇄" is changed to --"V"--.

Column 6, line 26, "The" is changed to --They--.

Column 10, line 53, "v2.3c", is changed to --v2.3c--.

Column 10, line 59, --following it-- is added between "found" and "more".

Column 19, line 4, "Crossword Word Master" is changed to --Crossword Master--.

Column 19, line 47, "T" is changed to --W--.

Column 19, line 48, "Four-letter" is changed to --Five-letter--.

Column 24, line 7, the period (.) is changed to a semicolon (;)

Column 24, line 11, the period (.) is changed to a semicolon (;)

UNITED STATES PATENT AND TRADEMARK OFFICE

CERTIFICATE OF CORRECTION

PATENT NO. : 4,205,852

DATED : June 3, 1980

INVENTOR(S) : PAUL L. WAYMAN

It is certified that error appears in the above-identified patent and that said Letters Patent are hereby corrected as shown below:

Column 24, line 24, the period (.) is changed to a semicolon (;) and the word --and-- is added thereafter.

Signed and Sealed this

*Seventh* Day of *October 1980*

[SEAL]

*Attest:*

SIDNEY A. DIAMOND

*Attesting Officer*

*Commissioner of Patents and Trademarks*